US010413471B2

(12) United States Patent
Marom

(10) Patent No.: US 10,413,471 B2
(45) Date of Patent: Sep. 17, 2019

(54) WALKER DEVICE

(71) Applicant: Dan Marom, Or-Yehuda (IL)

(72) Inventor: Dan Marom, Or-Yehuda (IL)

( * ) Notice: Subject to any disclaimer, the term of this patent is extended or adjusted under 35 U.S.C. 154(b) by 29 days.

(21) Appl. No.: 15/563,622

(22) PCT Filed: Mar. 31, 2016

(86) PCT No.: PCT/IL2016/050343

§ 371 (c)(1),
(2) Date: Oct. 2, 2017

(87) PCT Pub. No.: WO2016/157187

PCT Pub. Date: Oct. 6, 2016

(65) Prior Publication Data

US 2018/0256436 A1 Sep. 13, 2018

Related U.S. Application Data

(60) Provisional application No. 62/141,873, filed on Apr. 2, 2015.

(51) Int. Cl.

| | |
|---|---|
| ***A61H 3/04*** | (2006.01) |
| ***A61G 7/10*** | (2006.01) |
| ***A61H 3/00*** | (2006.01) |

(52) U.S. Cl.

CPC ..... *A61H 3/04* (2013.01); *A61G 7/1015* (2013.01); *A61G 7/1019* (2013.01); *A61H 3/008* (2013.01);*A61G 2200/52* (2013.01); *A61H 2003/002* (2013.01); *A61H 2201/0176* (2013.01); *A61H 2201/0192* (2013.01); *A61H 2201/1215* (2013.01); *A61H 2201/1238* (2013.01); *A61H 2201/1635* (2013.01); *A61H 2201/1664* (2013.01); *A61H 2201/5051* (2013.01); *A61H 2203/0406* (2013.01); *A61H 2203/0425* (2013.01)

(58) Field of Classification Search

CPC . A61H 3/04; A61H 3/00; A61H 3/008; A61H 1/0262; A61G 7/14; A61G 7/1019;

(Continued)

(56) References Cited

U.S. PATENT DOCUMENTS 924,075 A * 6/1909 Johnson ..... A61G 13/12 5/621
2,339,007 A * 1/1944 Gahm ..... A61G 7/1019 297/5

(Continued)

FOREIGN PATENT DOCUMENTS

CN 201524363 * 7/2010 ..... A62B 35/00
KR 20030016902 A * 3/2003 ..... A61G 5/00
WO WO-03017894 A1 * 3/2003 ..... A61G 5/00

OTHER PUBLICATIONS

CN 204219295, Wang Y. et al. , (Mar. 25, 2015), Titile "Lower Limb lifting frame for use during blood vessel surgery", (Year: 2015).*

*Primary Examiner* — Winnie Yip
(74) *Attorney, Agent, or Firm* — Mark M. Friedman

(57) ABSTRACT

A walker device for lifting and supporting a body of a person is provided. The walker device includes a structure having a first side member and a second side member, the first side member and the second side member are configured to be disposed on a vertical surface and extend upwards, and a top member coupling the first and second side member to one another at a top portion thereof, such that at least a bottom portion of the first side member is disposed at distance from a bottom portion of the second side member. The walker device further includes a lift coupled to the top portion and having a gripping member disposed between the first and second side members and configured to be displaced up and down by the lift.

17 Claims, 6 Drawing Sheets

(58) Field of Classification Search
CPC .. A61G 7/1015; A61G 7/1059; A61G 7/1013; A61G 7/1036; A61G 5/00; A61G 5/14; A61G 7/10; A61G 5/02
USPC ..... 135/66–67; 482/66–67, 69, 140, 143; 5/81.1 R, 83.1, 86.1, 87.1, 88.1
See application file for complete search history.

(56) References Cited

U.S. PATENT DOCUMENTS

| | | | | | |
|---|---|---|---|---|---|
| 4,995,412 | A * | 2/1991 | Him | A61H 3/00 | 135/67 |
| 5,348,336 | A * | 9/1994 | Fernie | A61H 3/04 | 280/42 |
| 5,365,621 | A * | 11/1994 | Blain | A61G 7/1017 | 5/83.1 |
| 6,733,018 | B2 * | 5/2004 | Razon | A61H 3/008 | 135/67 |
| 6,935,353 | B2 * | 8/2005 | Hawkes | A61H 3/008 | 135/67 |
| 7,294,094 | B1 * | 11/2007 | Howle | A61H 3/00 | 135/67 |
| 8,286,281 | B1 * | 10/2012 | Toothman | A61G 7/1015 | 248/166 |
| 9,131,662 | B2 * | 9/2015 | VanDommelen | A01K 27/003 | |
| 2010/0318005 | A1 * | 12/2010 | Amonette | A61H 3/008 | 601/23 |
| 2016/0158088 | A1 * | 6/2016 | Frankian | A61H 3/04 | 482/69 |
| 2017/0165145 | A1 * | 6/2017 | Aryananda | A61H 3/008 | |

* cited by examiner

WALKER DEVICE

FIELD OF INVENTION

The presently disclosed subject matter relates to a walker device for a disabled people, in general, and in particular to walker device having a lift.

BACKGROUND

Walker devices are used mainly by disabled people, such as handicap, disabled elderly or people who suffer diseases. Some walker are configured to provide balance or stability while walking while other device are configured to lift the disabled people.

U.S. Pat. No. 9,149,408 discloses a mobility assistance apparatus having first and second frames positioned on left and right sides of a user; a hinge arm mechanism coupled to the first and second frames; and a harness or a walking seat coupled to the frames to transfer at least a portion of the user's body weight from the legs and to transfer weight through the user's hip or pelvis to the first and second frame enabling the user to stand or walk for an extended period without requiring the user's arms to hold the frame.

US 20030137119 discloses a stand up walker for supporting body weight in a standing position is provided with a pair of upper lift arms pivotally mounted on a walker frame and having lift spring means mounted on the walker frame. In the preferred embodiment a pair of lift springs comprise gas springs for asserting a lifting force to the body by means of a body seat and harness coupled to the upper lift arms. However, the upper lift arms may be provided with resilient handles that apply the lifting force under the armpits or a combination of lifting forces may be employed.

US 20050156395 discloses a pair of arm rest platforms and vertical handles so the user of a rolling walker can have added or alternate support not provided by a conventional rolling walker or rollator. The arm rest platforms are supported at a vertical distance above the conventional walker by providing a pair of arm rest frames each extending between the main frame of the conventional walker and a respective arm rest platform. The arm rest frames each includes an main arm rest frame member carried by the main frame of the conventional walker and an arm rest support member to carry the arm rest platform and vertical handles. The conventional hand brakes can also be relocated; to be operated when gripping the vertical handles. The arm rest platforms can be adjusted in both horizontally and vertically with respect to the main frame of the conventional walker for better distribution of the user's weight.

US 20060254631 discloses an assistive walking rear entry device including a main frame, elongated upright body weight support members connected to each side portion of the main frame and two elongated leg members connected to each body support member one extending forwardly, the other extending rearwardly, each leg member including a rollable member attached to a distal end portion thereof. An elongated seat is attached to and supported on a lower portion of a centerpost, the centerpost being supported on the main frame. Rearwardly opening lateral torso supports are attached to the upper portion of the centerpost and make supporting contact with the thoracic area and for propelling the device during a walking gait. The seat is positioned against the perennial region to support the pelvis and to help propel the device on a "hands free" basis. The body weight support members are preferably multi-function for body weight support during a walking gait and preferably are tied together by a cross member to insure identical side-to-side displacement.

US 20090050187 discloses a walker has a plurality of legs each terminating at a free end with rolling members operably attached to at least a pair of the free ends. The rolling members are configured for rolling engagement with a ground surface. The walker further includes a pair of handles configured for gripping by a user's hands while walking and a pair of upright support members that extend upwardly to free ends. The upright support members are configured for engagement with the user's underarms to bear weight of the user and to transfer at least a portion of the user's weight to the rolling members while walking.

US 20150115556 discloses a mobility walker. The mobility walker includes a removably attached lower section, middle section and upper section. Four wheels are connected to the lower section. A harness attachment spring is attached to the upper section. A user wearing the harness is attached via the harness to the harness attachment spring. The user is then able to walk, maneuver himself and exercise while utilizing the mobility walker.

SUMMARY OF INVENTION

There is provided in accordance with an aspect of the presently discloses subject matter a walker device for lifting and supporting a body of a person is provided. The walker device includes a structure having a first side member and a second side member, the first side member and the second side member are configured to be disposed on a vertical surface and extend upwards, and a top member coupling the first and second side member to one another at a top portion thereof, such that at least a bottom portion of the first side member is disposed at distance from a bottom portion of the second side member. The walker device further includes a lift coupled to the top portion and having a gripping member disposed between the first and second side members and configured to be displaced up and down by the lift.

The lift can be configured for lifting and supporting a body of a person.

The top portion can be disposed at a height allowing a disabled person to stand or sit between the first side member and the second side member. The first side member and the and second side member can be vertically extendable, adjusting thereby a height of the structure. The distance can be adjustable. At least one of the first and second side members can be pivotally coupled to the top portion such that the distance can be adjusted A dimensions of the top portion can be adjustable, wherein the dimension extends between the first and second side members such that the distance can be adjustable.

The structure can further includes a pivoting arm coupled to the first and second side members and configured to pivot and thereby displace the first and second side members towards or away from one another. The pivoting arm can include a sliding member configured to pull the joints upwards to the folded state. The sliding member can be operated by an automatic drive.

The lift can include an extending arm configured to shift between and extended position and a retracted position and wherein the gripping member can be coupled to a distal end of the extending arm by a strap, and wherein at the retracted position the gripping member can be at a bottommost position thereof, and at the extended position the gripping member can be at an uppermost position thereof.

The gripping member can include two rings, each extending adjacent one of the first and second side members and being configured to be disposed over an arm of a disabled person. By shifting the extending arm from the retracted position to the extended position the rings are displaced from a height in which the rings are configured to be griped by a person in a sitting position to a height configured to be gripped in a standing position. The rings are configured to be mounted under the axilla of a disabled person.

The lift can include a rotating spool and wherein the gripping member can be coupled to the rotating spool by a strap, and wherein the rotating spool can be configured to selectively wind or unwind the strap thereon displacing thereby the gripping member up and down with respect to the lift.

The rotating spool can include a first spool and a second spool configured to rotate in opposing directions, and wherein one section of the strap extends from the first spool downwards adjacent the first side member and second section of the strap extends from the second spool downwards adjacent the first side member.

The lift can further include an anti-tangle member configured to straighten the strap. The anti-tangle member can be disposed on the top portion.

The structure can further include a telescopic rod coupled on one end thereof to the first side member and on a second end thereof to a second side member. The telescopic rod can be configured to retrace and extend adjusting thereby the distance.

BRIEF DESCRIPTION OF THE DRAWINGS

In order to understand the disclosure and to see how it may be carried out in practice, embodiments will now be described, by way of non-limiting examples only, with reference to the accompanying drawings, in which.

DETAILED DESCRIPTION OF EMBODIMENTS

Figure 1A:
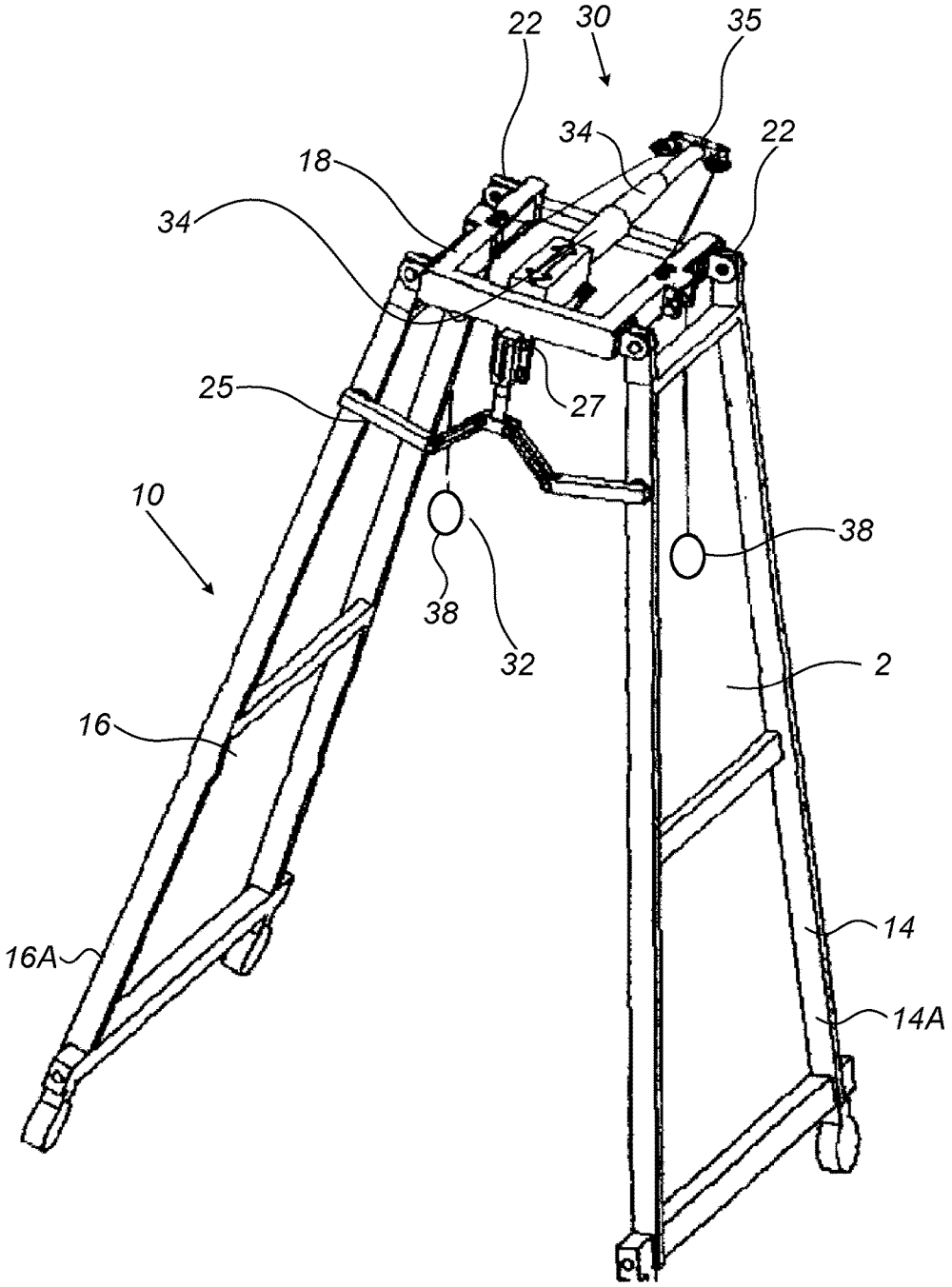
FIG. 1A is a perspective view of a walker device in accordance with an example of the presently disclosed subject matter.
Figure 1B:
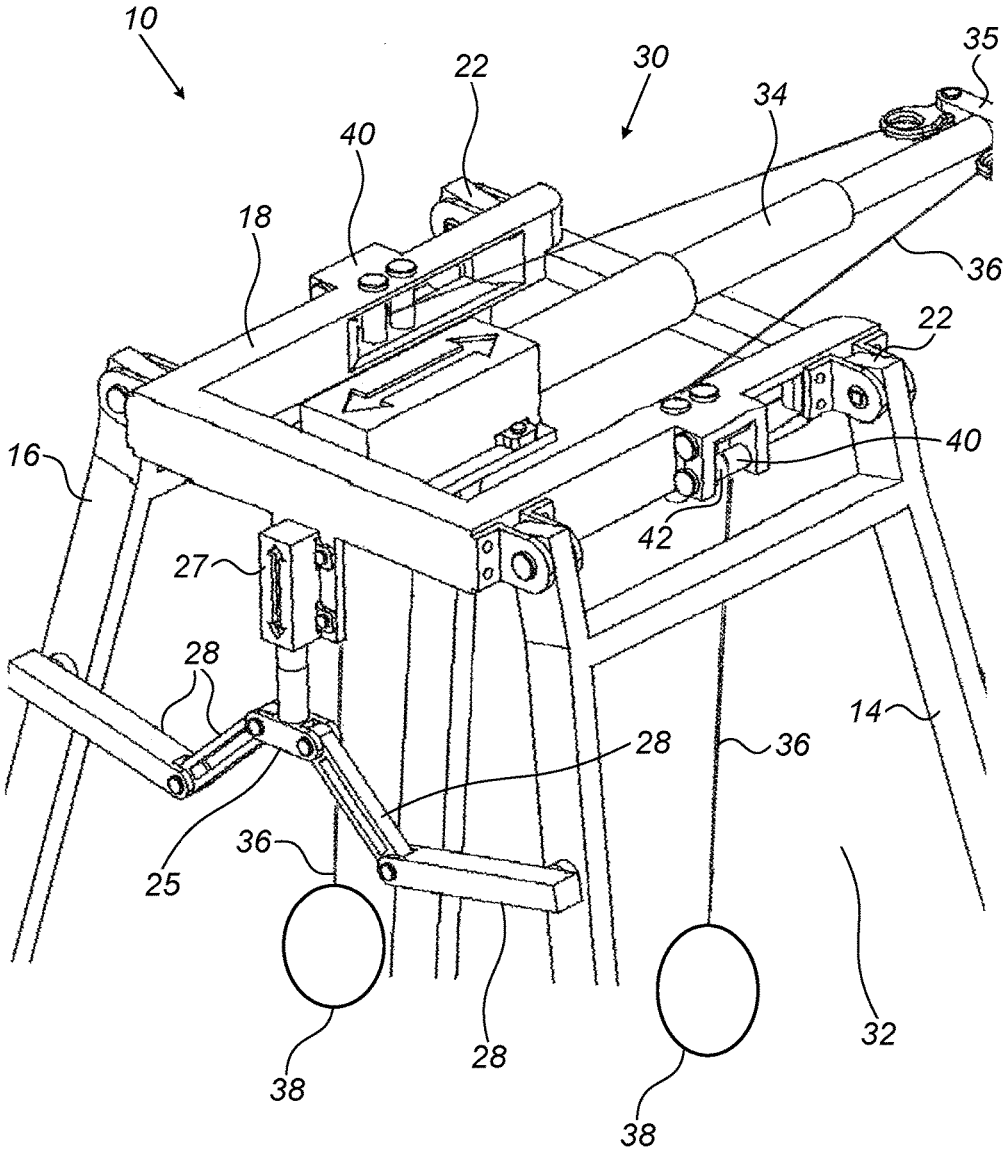
FIG. 1B is a perspective view of the walker device of FIG. 1A with a lift in the upwards state.
Figure 1C:
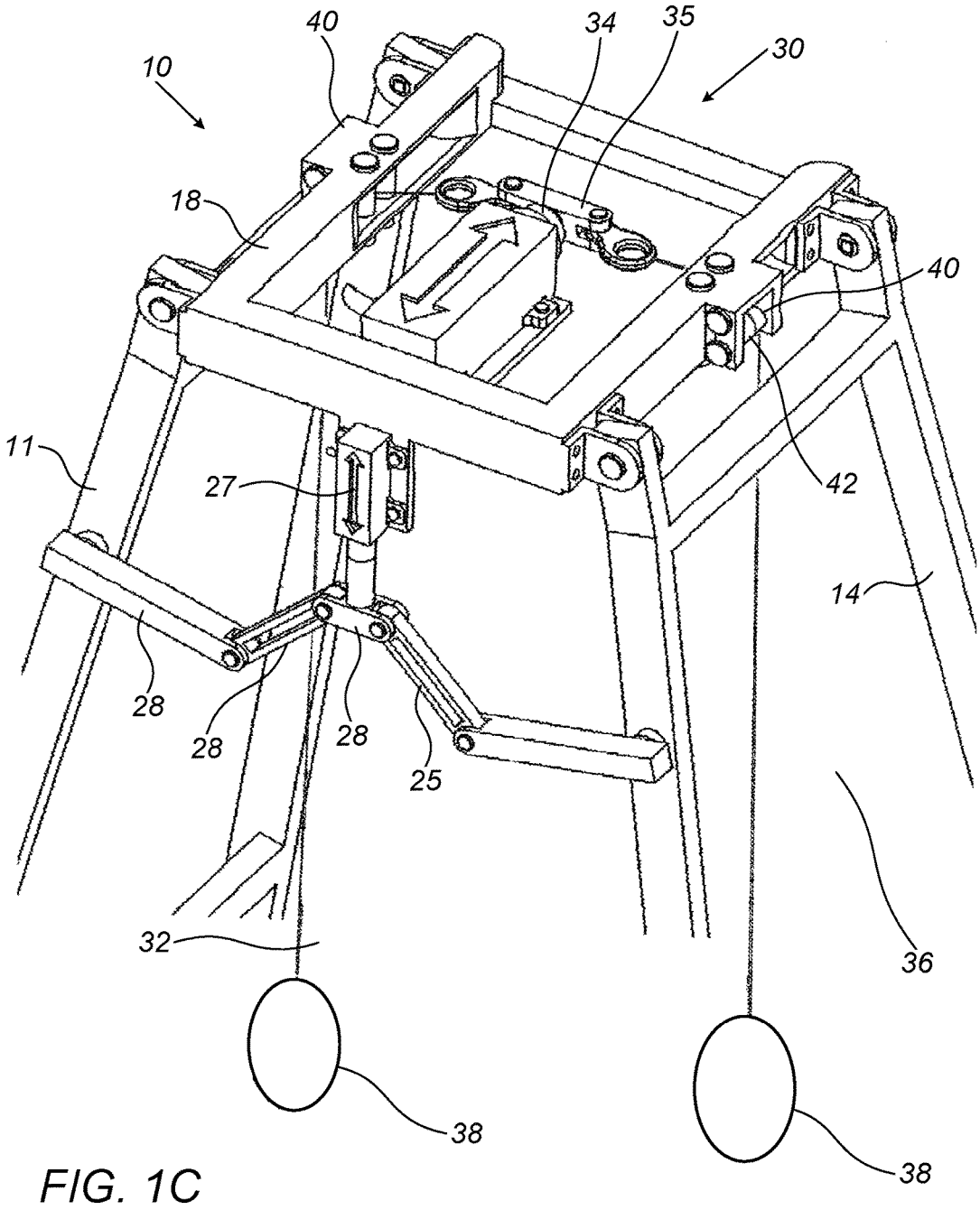
FIG. 1C is a perspective view of the walker device of FIG. 1A with a lift in the downwards state.

FIGS. 1A to 1C shows a walker device 10 having a lift 30 for lifting and supporting a body of a person, such a disabled person. The walker device 10 includes a structure 12 configured to allow a disabled person to be supported by two sides of the structure. The structure 12 includes a first side member 14 and a second side member 16 configured to be disposed on a surface, such as a floor or the ground, and to extend upwards. The structure 12 further includes a top member 18 coupling the first and second side members 14 and 16 to one another at a top portion thereof. The top portion 18 is configured such that at least a bottom portion 14*a* of the first side member 14 is disposed at distance from a bottom portion 16*a* of the second side member 16. This way, a person can be disposed between the first and second side members 14 and 16. It is appreciated that in order to allow a disabled person to stand or sit between the first and second side members 14 and 16, the top portion 18 is disposed at a height which allows the disabled person to stand or sit between the first and second side members 14 and 16.

According to an example, the first and second side members 14 and 16 can be extendable such that the height thereof can be adjusted in accordance with the height of disabled person, or such that the overall height of the walker device 10 meets other requirements. For example, the overall height of the walker device 10 can be determined such that the walker device 10 can be maneuvered within a residential room equipped with furniture etc.

According to an example, the distance between the first and second side members 14 and 16. For example, the between the first and second side members 14 and 16 can be coupled to the top portion 18 by hinges 22, such that the first and second side members 14 and 16 can be pivoted with respect to the top portion 18 adjusting thereby the distance between the bottom portion 14*a* of the first side member 14 and the bottom portion 16*a* of the second side member 16. This way, the side members 14 and 16 can be pulled towards one another and the structure 12 can be maneuvered in areas with limited space, for example a doorway, etc.

According to other examples, the dimensions of the top portion 18 can be adjustable for example, the bars extending between the first and second side members 14 and 16 can be telescopic, such that the distance between the latter can be adjusted as required.

According to an example, the structure 12 can further include a pivoting arm 25 coupled to the first and second side members 14 and 16 and configured to pivot and thereby displace the side members towards or away from one another. The pivoting arm 25 can be configured with number of folding joints 28, configured between a deployed state and a folded state. In the deployed state the joints 28 are horizontally disposed urging thereby the first and second side members 14 and 16 away from one another. In the folded state, on the other hand, the joints 28 are folded and disposed such that at least some of them are vertically disposed, pulling thereby the first and second side members 14 and 16 towards one another.

The pivoting arm 25 can be including a sliding member 27 configured to pull the joints 28 upwards, to the folded state, pulling thereby the first and second side members 14 and 16 towards one another. For example the pivoting arm 25 can include a joint extending from each of the first and second side members 14 and 16, and a sliding member 27 coupling the two joints 28 together and being coupled to the top portion 18, such that when the sliding member 27 slides upwardly towards the top portion 18 the side members 14 and 16 are pulled towards one another.

According to an example the sliding member 27 can be operated by an automatic drive, such as a pneumatic or electric motor, and can be controlled by a user via a designated control panel (not shown).

According to an example the first and second side members 14 and 16 are provided with wheels 20 such that the walker device 10 can be maneuvered around the house. For example the disabled person can hold the first and second side members 14 and 16 such that the structure 12 provides him with stability and balance and independently walk around the house.

The walker device 10 further includes a lift 30, coupled to the top portion 18 and having a gripping member 32 attached thereto. The gripping member 30 is disposed between the first and second side members 14 and 16 and is configured to be displaced up and down by the lift.

According to the illustrated example the lift 30 includes an extending arm 34 configured to shift between and extended position (shown in FIG. 1B) and a retracted position (shown in FIG. 1C). The gripping member 32 according to this example further includes a strap 36 coupled to the distal end 35 of the extending arm 34 and extending downwards between the first and second side members 14 and 16. This way, the strap 36 and the gripping member 32 are displaced by the extending arm 34 up and down. I.e., at the retracted position of the extending arm 34 the strap 36 and the gripping member 32 are at the bottommost position thereof, while at the extended position of the extending arm 34 the strap 36 is pulled by the distal end 35 of the extending arm 34 pulling therewith the gripping member 32 to the uppermost position thereof.

According to the present example, the gripping member 32 includes two rings 38, each extending adjacent one of the first and second side members 14 and 16. The rings 38 are configured to be disposed over an arm of a disabled person, and are disposed such that each ring is located adjacent one arm of a disabled person standing or sitting between the first and second side members 14 and 16.

The strap 36 according to this example extends down from two sides of the distal end 35 of the extending arm 34, such that each of the rings 38 is coupled to one side of the strap 36. This way, a disabled person sitting between the first and second side members 14 and 16 can insert his/her arms into the rings 38. When the extending arm 34 is shifted to the extended position thereof the two sides of the strap 36 are pulled by the distal end 35 of the extending arm 34 pulling therewith the rings 38 and the disabled person holding the rings 38. Thus, assisting the disabled person to shift from a sitting position to a standing position.

According to an example, the rings 38 can be configured to be mounted under the axilla of a disabled person, such that when the rings 38 are lifted, the disabled person is lifted therewith.

The lift 30 can further includes an anti-tangle member 40, which can be disposed on the top portion of the first and second side members 14 and 16. The anti-tangle member 40 can include two members each of one of the first and second side members 14 and 16. The anti-tangle member 40 can include two or more rollers 42 configured such that the strap 36 slides therebetween, and is straightened, ensuring thereby the smooth displacement of the strap 36 up and down.

Figure 2:
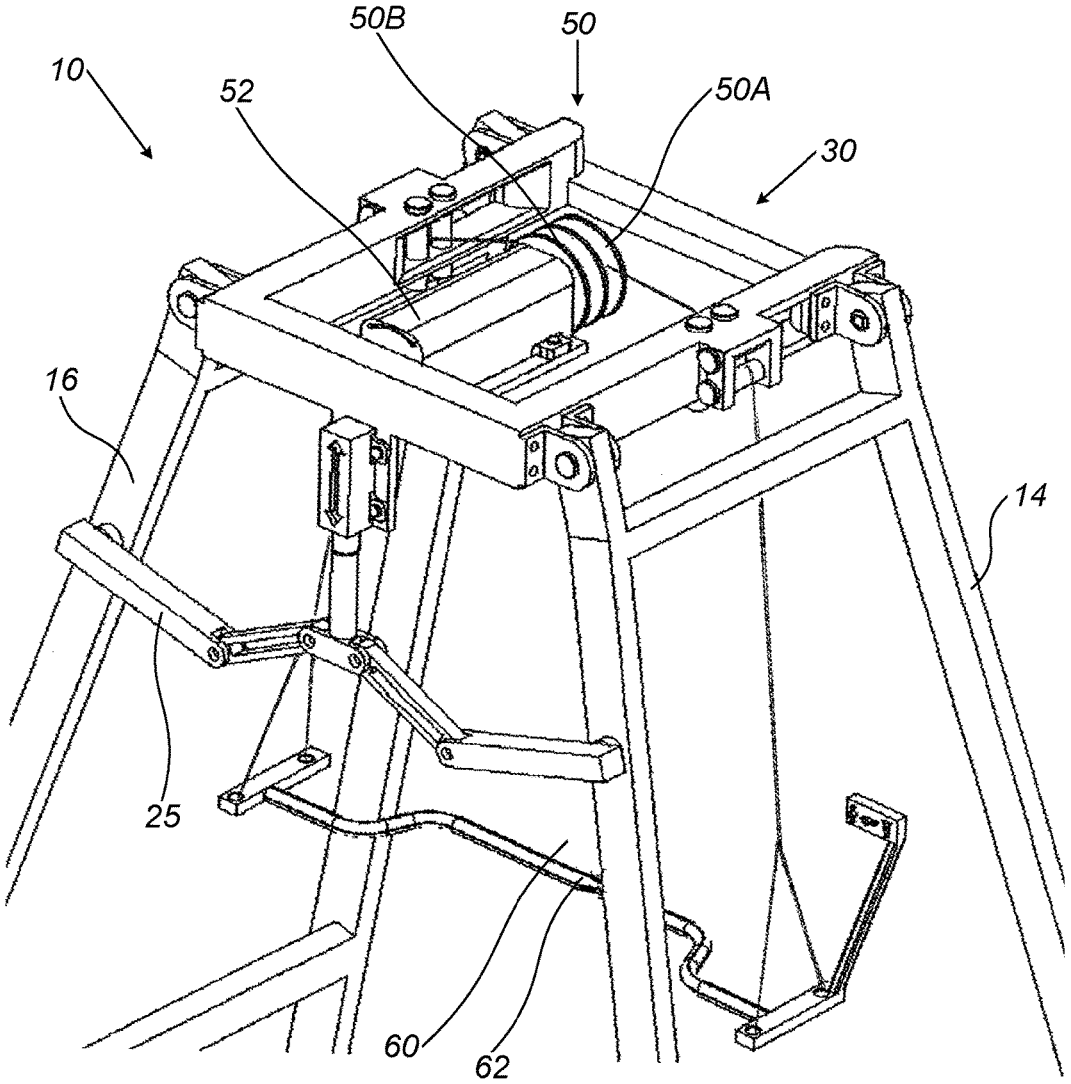
FIG. 2 is a perspective view of a walker device in accordance with another example of the presently disclosed subject matter.

Reference is now made to FIG. 2, in another example of the walker device 10, in which like elements are designated by like reference numerals, the lift 30 can include a rotating spool 50 operated by a motor 52, and configured to wind the strap 36 thereon. Since, according to the present example, the strap 36 is disposed on two sides of structure 12, i.e. adjacent the first and second side members 14 and 16. The rotating spool 50 includes a first spool 50*a* rotating in one direction and a second spool 50*b* rotating in an opposite direction.

The rotating spool 50 is configured to rotate in an extending state, in which the strap 36 is displaced downwardly, and in a collecting state in which the strap 36 is pulled upwardly. Thus, in the extending state each of the first and second spools 50*a* and 50*b* is rotated in a direction towards the first and second side members 14 and 16, respectively, such that the strap 36 is displaced downwardly, along the first and second side members 14 and 16.

In the collecting state, on the other hand, each of the first and second spools 50*a* and 50*b* is rotated in a direction toward the middle of the structure 12, thereby pulling the strap 36 upwardly.

It should be noted, that while the displacement of the extending arm 32 of the previous example to the extended position is limited by the length of the arm 32, the rotation of the motor 52 and the spool 50 is not limited, such that a continuous rotation of thereof can pull the gripping member 32 such that it can cause harm to the disabled person. Thus, the motor 52 can be provided with a safety sensor, configured to stop the operation thereof as the gripping member reaches a predetermined height.

The walker device according to the illustrated example include a gripping member 60 in the form of a horizontal rod 62. The horizontal rod 62 is coupled to the straps 36 at the two ends thereof, i.e. adjacent the first and second side members 14 and 16, such that the horizontal rod 62 can be pulled up and down. The horizontal rod 62 can be configured to be gripped by a disabled person, or to be disposed under the axilla of a disabled person, such that when the horizontal rod 62 is pulled up by the lift 30 the disabled person is lifted up therewith, for example from sitting position to standing position.

Figure 3:
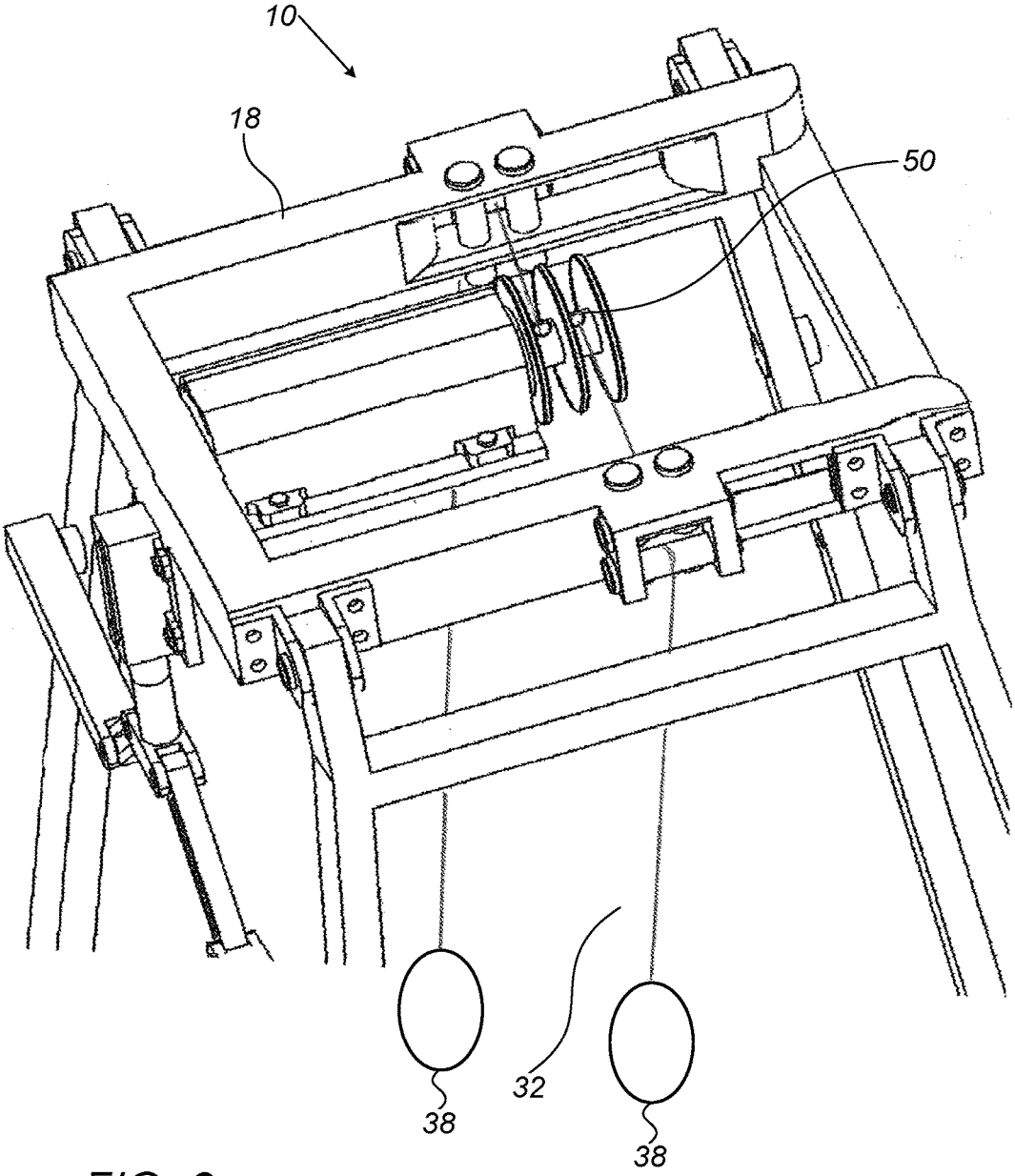
FIG. 3 is a perspective view of a walker device in accordance with another example of the presently disclosed subject matter; and, FIG. 4 is a perspective view of a walker device in accordance with yet another example of the presently disclosed subject matter.

FIG. 3 illustrates another example of the walker device 10, in which like elements are designated by like reference numerals, and in which the lift 30 includes a rotating spool 50, as in the example of FIG. 2, and a gripping member 32 having a pair of rings 38 as in the example of FIGS. 1A to 1C.

Figure 4:
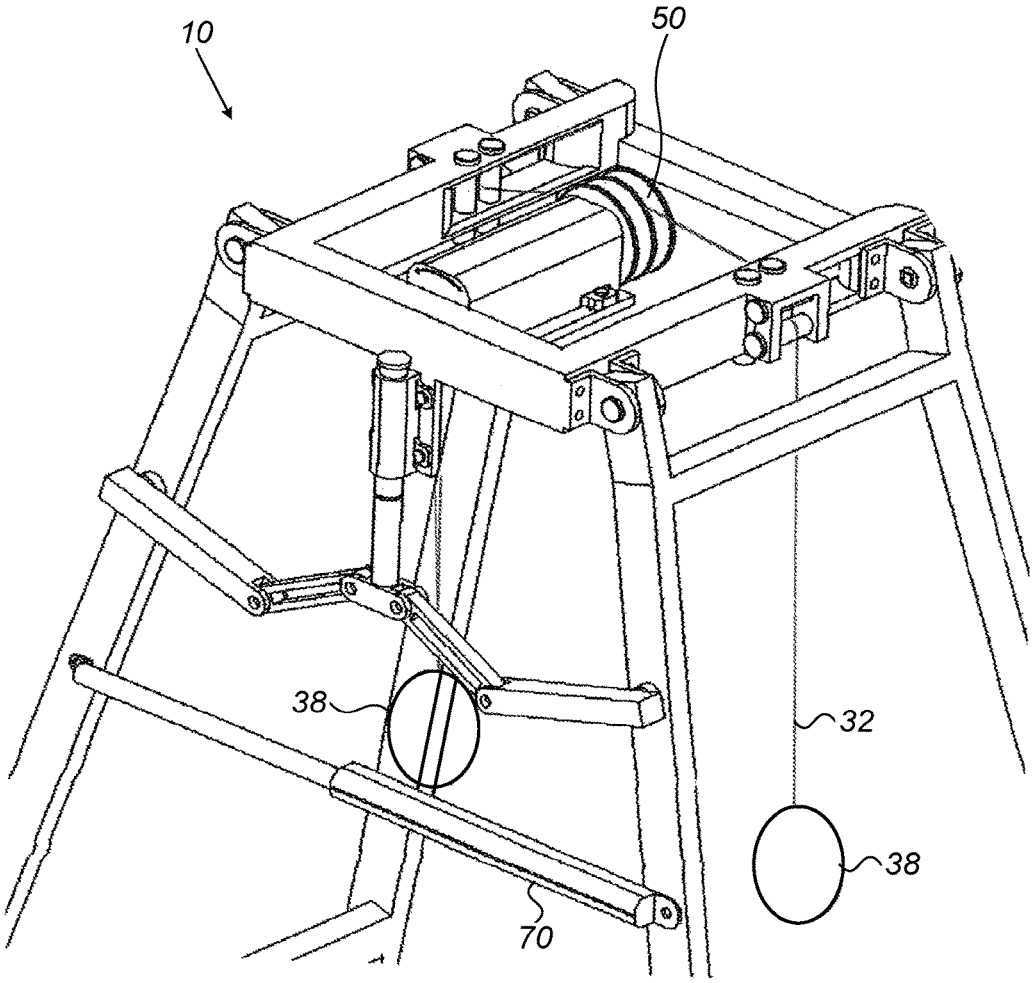

FIG. 4 illustrates an example of the walker device 10, in which the lift 30 includes a rotating spool 50, as in the example of FIG. 2, and a gripping member 32 having a pair of rings 38 as in the example of FIGS. 1A to 1C. According to this example, however, the structure 12 includes a telescopic rod 70 coupled on one end thereof to the first side member 14 and on the other end thereof to the second side member 16. The telescopic rod 70 can be configured to retrace and extend depending on the distance between the first and second side members 14 and 16. The telescopic rod 70 can be configured with a drive configured to automatically and selectively retract or extend the telescopic rod 70 setting thereby the distance between the first and second side members 14 and 16.

It will be appreciated that according to the latter example, the sliding member does not include an automatic drive, rather the sliding member is displaced by the displacement of the telescopic rod. 70.

The telescopic rod 70 and the operation of the lift can be control via a control panel (not shown), such that a disabled person can independently stand or sit and walk around the house.

It is appreciated that while the lift is in the extended position, i.e. the gripping member is disposed upwardly, the latter can be configured to support the disabled person while walking. That is to say, the lift is configured to withstand the gravitational forces exerted by the disabled person.

Those skilled in the art to which the presently disclosed subject matter pertains will readily appreciate that numerous changes, variations, and modifications can be made without departing from the scope of the invention, mutatis mutandis.

The invention claimed is:

1. A walker device for lifting and supporting a body of a person, the walker device comprising:

a structure including:

a first side member and a second side member, the first side member and the second side member configured to be disposed on a horizontal surface and extend upwards, and a top member coupling the first and second side member to one another at a top portion thereof, such that at least a bottom portion of the first side member is disposed at distance from a bottom portion of the second side member; and a lift coupled to the top portion and including:

a gripping member disposed between the first and second side members and configured to be displaced up and down by the lift along a displacement axis substantially normal to the horizontal surface on which the first and second side members are disposed, and an extending arm having a distal end, and the gripping member operatively coupled to the distal end by a strap and configured to shift, between an extended position and a retracted position, along an axis normal to the displacement axis, such that:

when the extending arm is in the retracted position, the strap and the gripping member are displaced downward along the displacement axis so as to position the gripping member at a bottommost position thereof, and when the extending arm is in the extended position, the strap and the gripping member are displaced upward along the displacement axis so as to position the gripping member at an uppermost position thereof.

2. The walker device according to claim 1, wherein the lift is configured for lifting and supporting a body of a person.

3. The walker device according to claim 1, wherein the top portion is disposed at a height allowing a disabled person to stand or sit between the first side member and the second side member.

4. The walker device according to claim 3, wherein the first and second side members are vertically extendable, adjusting thereby a height of the structure.

5. The walker device according to claim 1, wherein the distance is adjustable.

6. The walker device according to claim 5, wherein at least one of the first and second side members is pivotally coupled to the top portion such that the distance can be adjusted.

7. The walker device according to claim 5, wherein the structure further includes: a pivoting arm coupled to the first and second side members and configured to pivot and thereby displace the first and second side members towards or away from one another.

8. The walker device according to claim 7, wherein the pivoting arm includes a pair of folding joints and a sliding member configured to pull the folding joints upwards to the folded state.

9. The walker device according to claim 8, wherein the sliding member is operated by an automatic drive.

10. The walker device according to claim 1, wherein the gripping member includes two rings, each extending adjacent one of the first and second side members and being configured to be disposed over an arm of a disabled person.

11. The walker device according to claim 10, wherein by shifting the extending arm from the retracted position to the extended position the rings are displaced from a height in which the rings are configured to be gripped by a person in a sitting position to a height configured to be gripped in a standing position.

12. The walker device according to claim 10, wherein the rings are configured to be mounted under the axilla of a disabled person.

13. The walker device according to claim 1, wherein the lift further includes an anti-tangle member configured to straighten the strap.

14. The walker device according to claim 13, wherein the anti-tangle member is disposed on the top portion.

15. The walker device according to claim 1, wherein the structure further includes a telescopic rod coupled on one end thereof to the first side member and on a second end thereof to the second side member.

16. The walker device according to claim 15, wherein the telescopic rod is configured to retrace and extend adjusting thereby said distance.

17. A walker device for lifting and supporting a body of a person, the walker device comprising:

a structure including:

a first side member and a second side member, the first side member and the second side member configured to be disposed on a horizontal surface and extend upwards, and a top member coupling the first and second side member to one another at a top portion thereof, such that at least a bottom portion of the first side member is disposed at distance from a bottom portion of the second side member; and a lift coupled to the top portion and including:

a gripping member disposed between the first and second side members and configured to be displaced up and down by the lift along a displacement axis substantially normal to the horizontal surface on which the first and second side members are disposed, a strap including a first strap section and a second strap section, wherein a portion of the first strap section and a portion of the second strap section are configured to be displaced along the displacement axis, and a rotating spool including a first spool and a second spool that rotate about a common axis, the first spool operatively coupled to the gripping member by the first strap section and the second spool operatively coupled to the gripping member by the second strap section, the rotating spool configured to selectively wind and unwind the strap by rotating the first and second spools in opposing directions of rotation so as to displace the gripping member and the portions of the strap sections along the displacement axis.

* * * * *